US006533073B2

(12) United States Patent
Chernik, Jr. et al.

(10) Patent No.: US 6,533,073 B2
(45) Date of Patent: Mar. 18, 2003

(54) CHECKOUT COUNTER CONSTRUCTION AND METHOD EMPLOYING BAG WELL FEATURE

(75) Inventors: Aleck M. Chernik, Jr., Jacksonville, FL (US); Dennis E. Finegan, Green Cove Springs, FL (US)

(73) Assignee: Load King Manufacturing Co., Jacksonville, FL (US)

( * ) Notice: Subject to any disclaimer, the term of this patent is extended or adjusted under 35 U.S.C. 154(b) by 23 days.

(21) Appl. No.: 09/829,581

(22) Filed: Apr. 10, 2001

(65) Prior Publication Data

US 2002/0020585 A1 Feb. 21, 2002

Related U.S. Application Data

(60) Provisional application No. 60/196,616, filed on Apr. 13, 2000.

(51) Int. Cl.[7] ..... A63F 9/02
(52) U.S. Cl. ..... 186/66
(58) Field of Search ..... 186/66; 248/185.1, 248/289.1, 289.11

(56) References Cited

U.S. PATENT DOCUMENTS

| | | | | | |
|---|---|---|---|---|---|
| 2,646,322 | A | * | 7/1953 | Laxo | 108/147 |
| 2,884,094 | A | * | 4/1959 | Roy | 186/66 |
| 3,840,092 | A | * | 10/1974 | Close | 186/66 |
| 4,512,540 | A | * | 4/1985 | Stroh | 248/95 |
| 4,637,322 | A | * | 1/1987 | Hampshire et al. | 108/102 |
| 4,789,048 | A | * | 12/1988 | Cramer et al. | 186/61 |
| 5,138,955 | A | * | 8/1992 | Manner | 108/1 |
| 5,706,912 | A | * | 1/1998 | Holland | 186/68 |
| 5,791,263 | A | * | 8/1998 | Watt et al. | 108/138 |
| 6,070,281 | A | * | 6/2000 | Reich | 5/610 |

* cited by examiner

*Primary Examiner*—Donald P. Walsh
*Assistant Examiner*—Jeffrey A. Shapiro
(74) *Attorney, Agent, or Firm*—Allen, Dyer, Doppelt, Milbrath & Gilchrist, P.A.

(57) ABSTRACT

A checkout counter construction and method employs a bag well feature using a cover member which is movable between a first, closed and latched position and a second, open position without using springs, pneumatic cylinders or any electrical connection, and in a manner which reduces the rate of movement of the cover member as it approaches the second position, in order to minimize any risk of injury.

16 Claims, 6 Drawing Sheets

CHECKOUT COUNTER CONSTRUCTION AND METHOD EMPLOYING BAG WELL FEATURE

RELATED APPLICATION

This nonprovisional application claims the priority date of copending provisional patent application Ser. No. 60/196,616 filed on Apr. 13, 2000, which is incorporated herein by reference in its entirety, the benefit of its earlier filing date being claimed under to 37 C.F.R. §1.78(a)(4).

BACKGROUND OF THE INVENTION

The present invention is related to checkout counters used in grocery stores and similar merchandising facilities, and in particular is related to checkout counter constructions and methods which provide a recessed bag well which permits the clerk to bag merchandise as it is being tallied.

Checkout counter constructions providing a bag well feature have in the past used a variety of techniques for permitting the well to be bridged with a cover, so that when the bag well is not being used, the merchandise is passed further along to a discharge area where the merchandise may be bagged by an employee other than the checkout clerk. Prior art arrangements have included simple slide mechanisms, as well as covers which may be rotated into place using springs or pneumatic cylinders operated by the clerk.

SUMMARY OF THE INVENTION

The present invention is directed to a checkout counter construction and method employing a bag well feature using a cover member which is movable between a first, closed and latched position and a second, open position in a facile manner without using springs, pneumatic cylinders or any electrical connection. This objective is further achieved in a construction which reduces the rate of movement of the cover member as it approaches the second position, in order to minimize any risk of injury. These objectives are achieved utilizing a bracket, latch and tension plate assembly which relies upon the weight of the cover member and an associated base to rotate about a pivot axis upon operation of a simple latch release lever by the clerk. The bag well assembly may then be returned to the first position by simply pulling the cover member forward from the second position until again latched into the first position.

Another aspect of the present invention is the construction of a bag well assembly which may be retrofitted into existing checkout counters without undue difficulties. This is achieved by recessing the rate of movement reduction assembly, the latch and the latch release elements into a side panel, so that the bag well assembly may be easily and simply inserted into an existing counter construction.

In the preferred embodiment, the rate of movement reduction mechanism employs a facile construction in which a sloped tension plate, either alone or in combination with an associated friction pad, increases the friction against movement of the cover member as it is rotating from the first to the second position, to thereby reduce the rate of movement as the cover member rotates into the second position.

DETAILED DESCRIPTION

Figure 1:
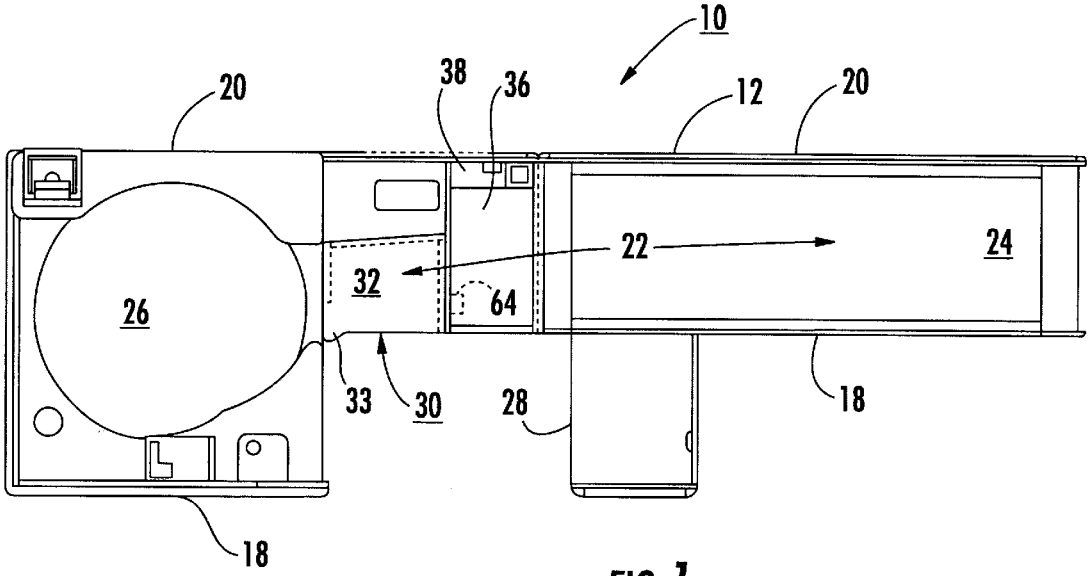
FIG. 1 is a top view of a checkout counter construction having a bag well feature in accordance with the present invention.

A preferred embodiment of the present invention will now be described with reference to the drawing.

Figure 2:
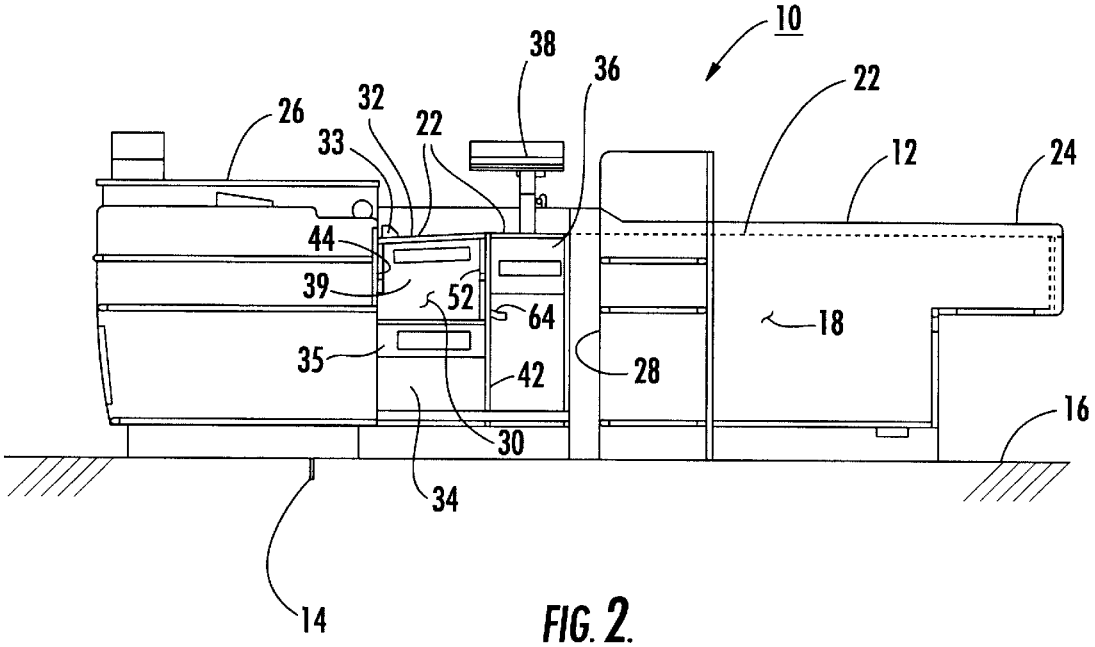
FIG. 2 is a side view of the checkout counter shown in FIG. 1.

First noting FIGS. 1 and 2, a checkout counter construction in accordance with the present invention is referred to generally by the reference numeral 10. The checkout counter 10 is formed from an elongated counter 12 having a bottom 14 adapted to rest upon a support surface 16, such as the floor of a supermarket, a retail establishment or similar commercial facility. The counter 12 is defined by first and second opposing sides 18, 20 extending from the bottom 14, and a generally horizontal checkout surface 22 extending between the opposing sides 18, 20 from an intake area 24 to a discharge area 26. The counter 12 also defines a clerk location 28 along a portion of the first side 18.

Figure 3:
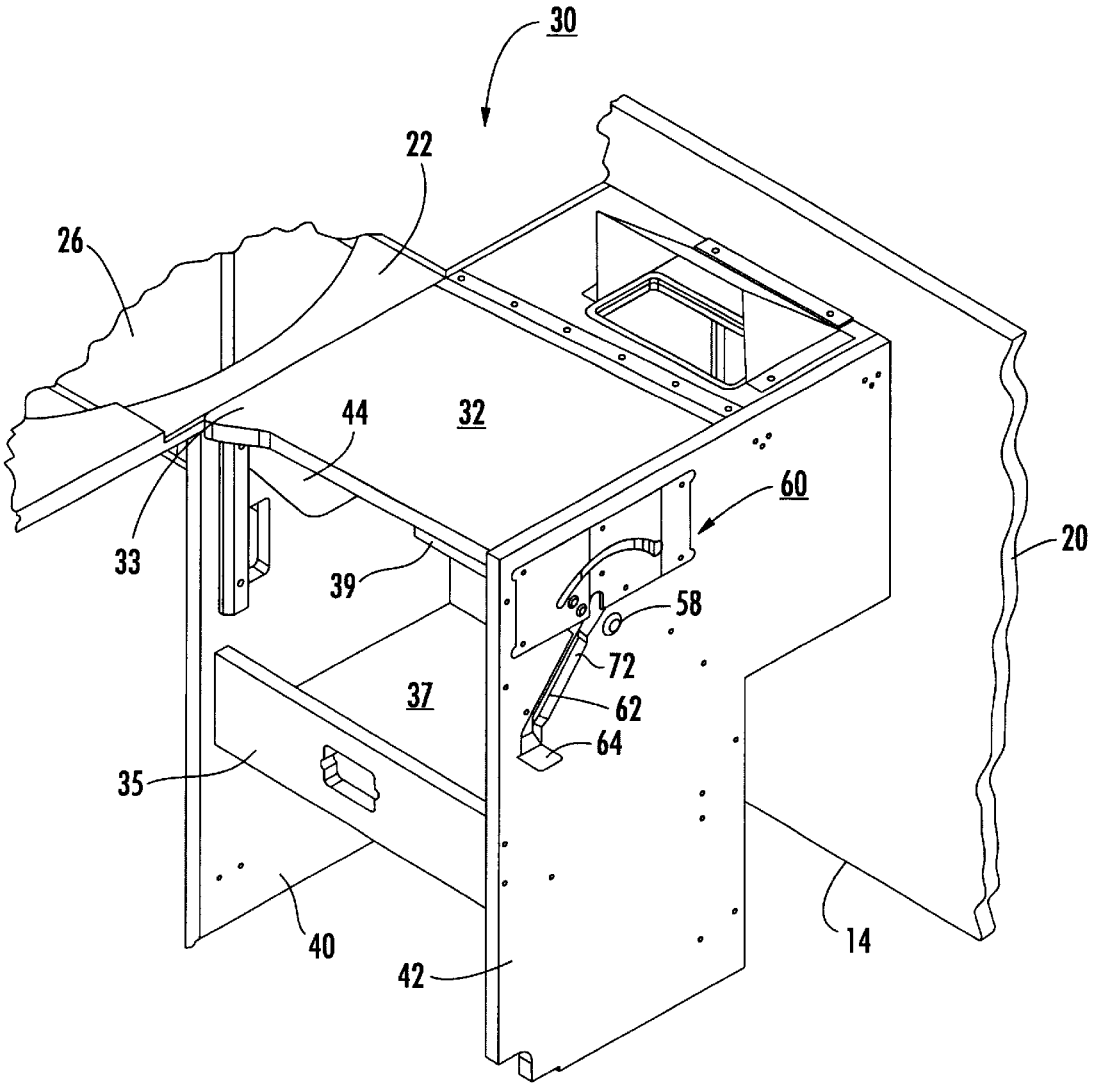
FIG. 3 is a partially cut away perspective view of a bag well assembly in accordance with the present invention, with the bag well cover member in the first, closed position.

In accordance with the present invention, the counter 12 is provided with a bag well 30 adjacent the clerk location 28, with the bag well 30 extending into the counter 12 from the checkout surface 22. As shown in FIGS. 1, 2 and 3, the bag well 30 includes a cover member 32 having an upper surface which lies generally in the plane of the horizontal checkout surface 22 when the cover member 32 is in a first, closed position. A storage area 34 is positioned underneath the bag well 30 below a bag well bottom 37 and a front panel 35. Typically, the bag well 30 is formed of a unitary assembly which is inserted into the counter 12 next to an electronic bar code scanner 36, which is used by a clerk at the location 28 to identify the price of merchandise as it is moved across the checkout surface 22 (as shown in FIG. 1, a portion of the checkout surface including the intake area 24 is typically a horizontal conveyor).

The details regarding the construction of the bag well 30 will now be described with reference to FIGS. 3–7; however, the relationship of the bag well assembly can also be further discerned with occasional reference to FIGS. 1 and 2.

FIG. 3 depicts the bag well assembly 30 with the cover member 32 in the first, closed position and with the upper surface of the cover member 32 generally forming a part of the checkout surface 22. The bag well 30 is defined by opposing, generally parallel side panels 40, 42 which extend laterally between the first and second sides 18, 20 of the counter 12 (only the second side 20 is shown in FIGS. 3 and 4).

Figure 4:
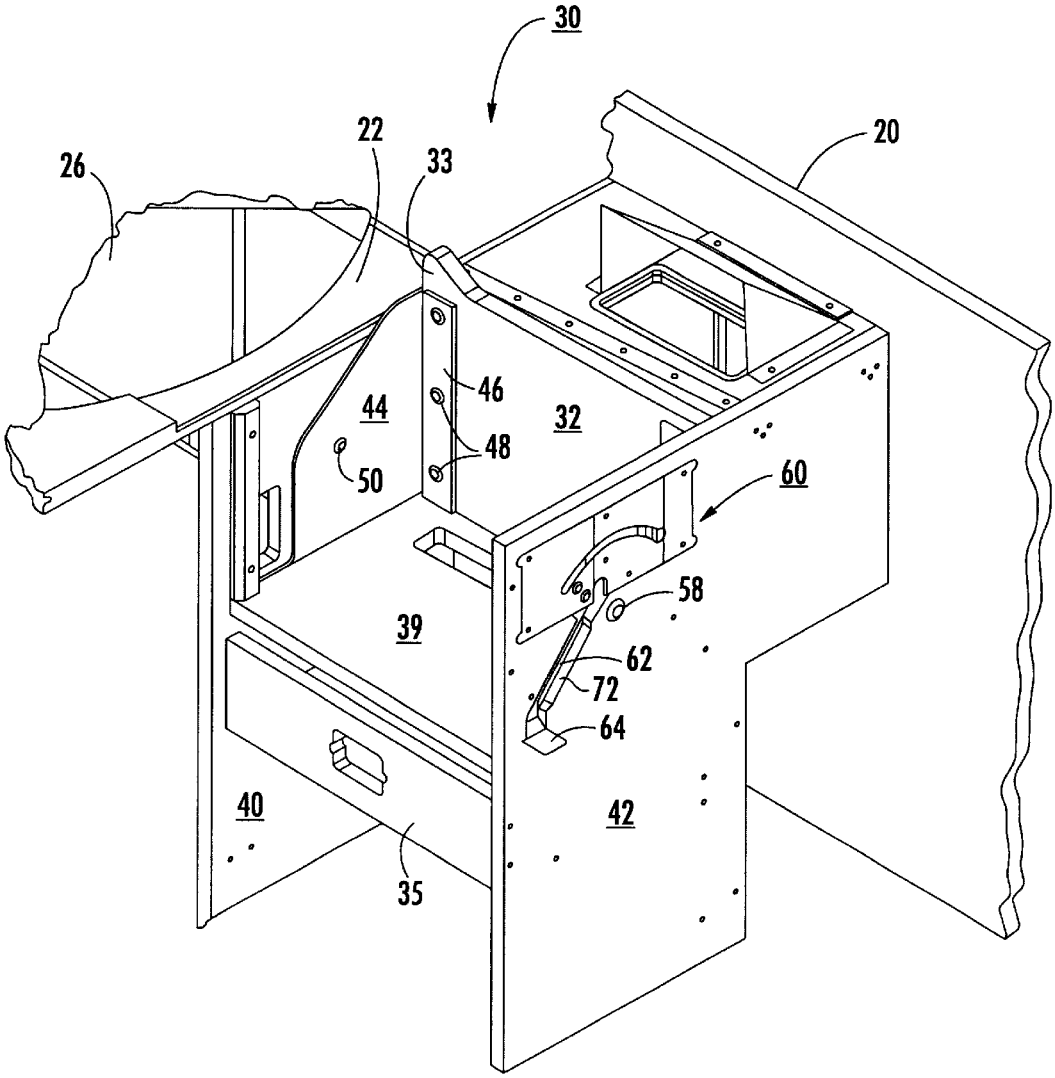
FIG. 4 is a perspective view, partially cut away, of a bag well assembly with the bag well cover member in the second, open position.
Figure 5:
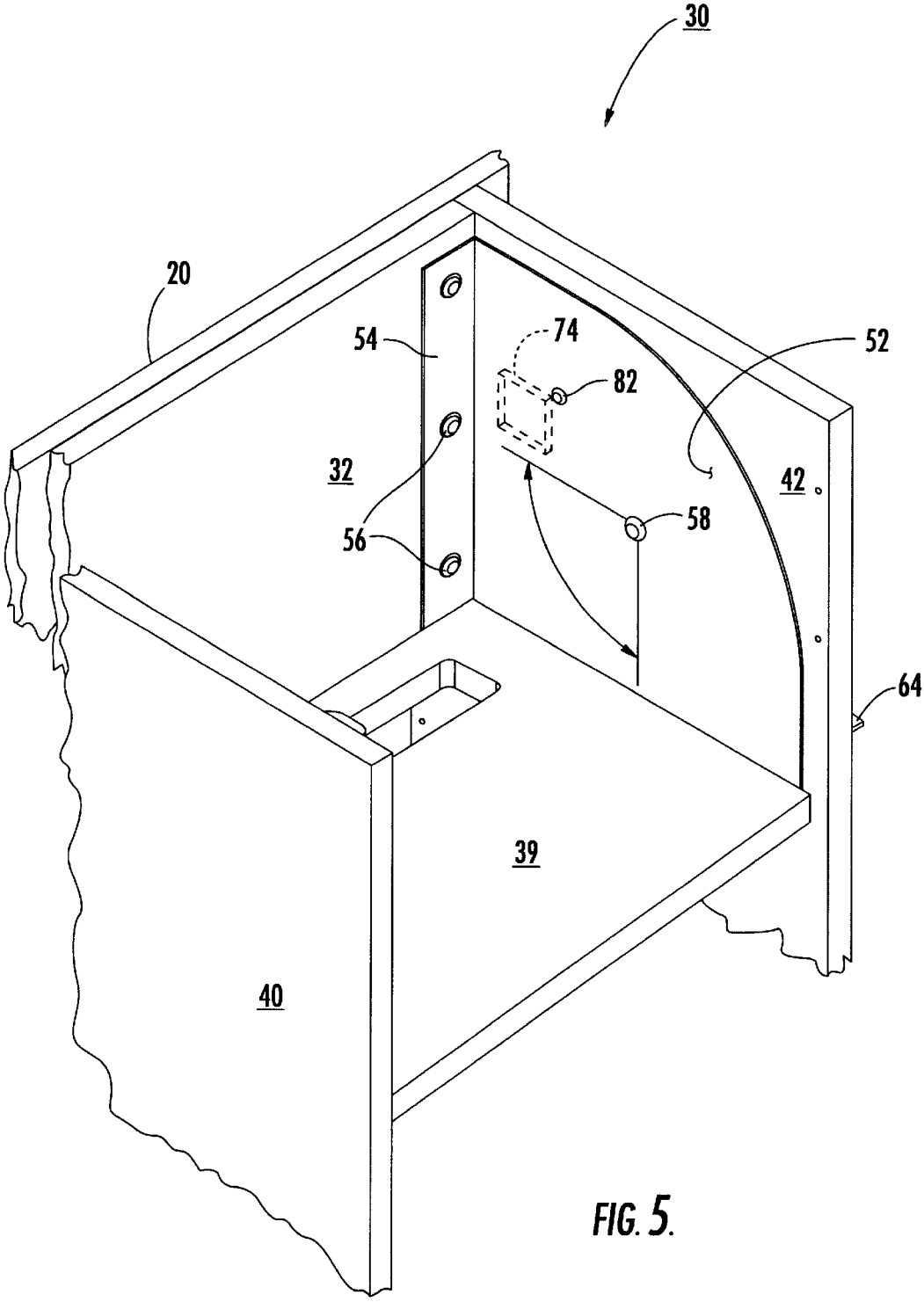
FIG. 5 is a perspective view, partially cut away, of a portion of the bag well assembly shown in FIGS. 3 and 4.
Figure 6:
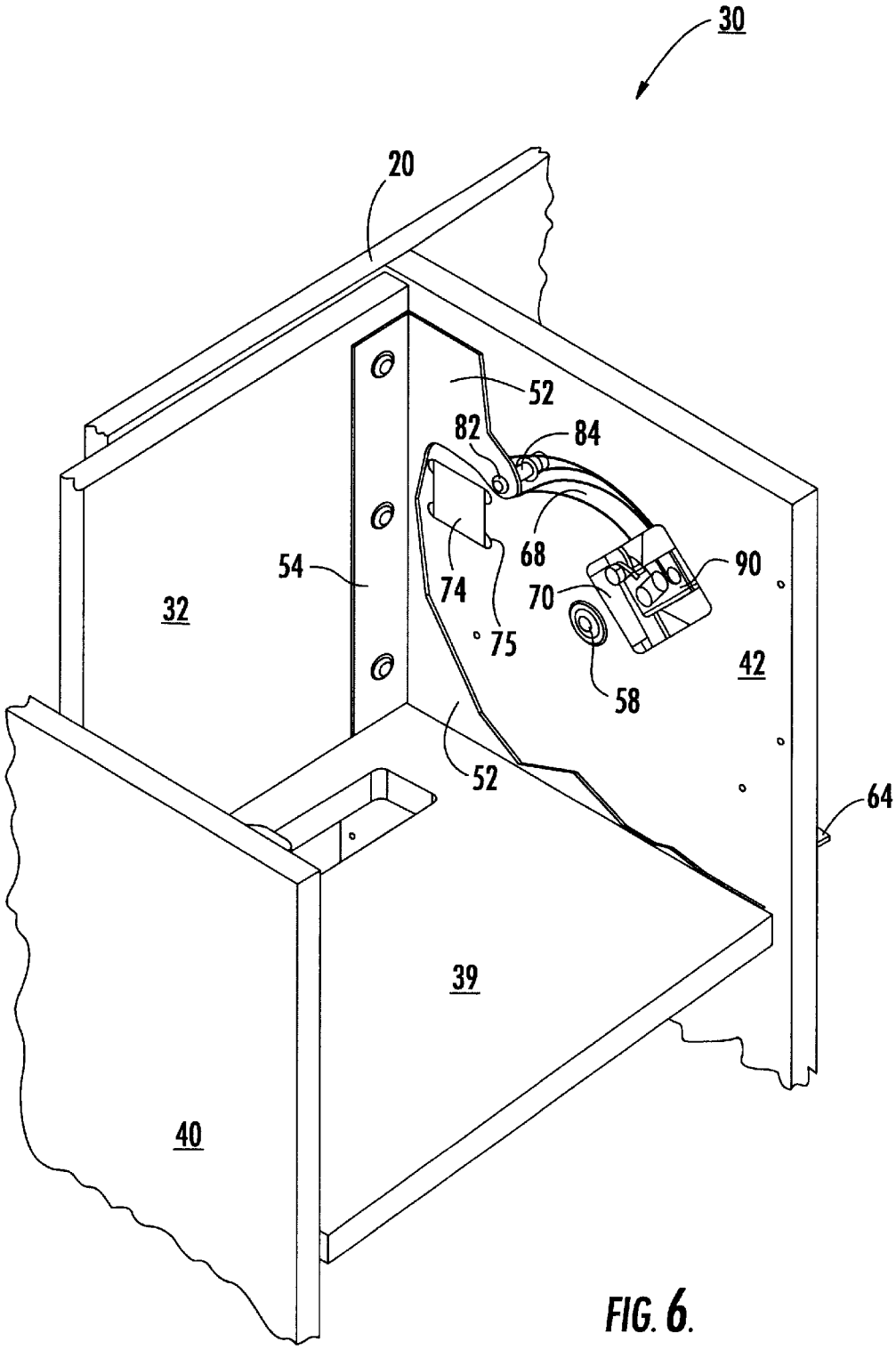
FIG. 6 is a perspective view like that shown in FIG. 5, with a portion of the bracket 52 cut away to illustrate the latch raceway and latch recess features.

The bag well assembly 30 is depicted in FIGS. 4, 5 and 6 with the cover member 32 rotated into a second, open position which permits the clerk's access to the bag well. In the second, open position the bag well base 39 forms the bottom of the well, against which the clerk may place a bag to be filled with merchandise as it is checked out following passage across the scanner 36 in the checkout surface 22. As is seen in FIGS. 4–6, the bag well assembly 30 includes a pair of opposing brackets 44, 52 which are attached to the underside of the cover member 32 for the use of a corresponding angled flange 46, 54 and associated fasteners 48, 56. The base 39 of the bag well 30 is fixed to and extends generally normal from the inside edge of the cover member 32, and is also attached with the brackets 44, 52 as a unitary assembly. Each of the brackets 44, 52 are pivoted to the respective bracket at corresponding pivots 50, 58.

It will thus be understood from the above description and FIGS. 3–6 that when the bag well cover member 32 is in the first, closed position, the bag well is not accessible by the clerk for packaging merchandise; rather, the merchandise passes along the upper surface of the cover member 32 to the discharge area 26. However, when the cover member 32 is rotated in the manner to be described in greater detail below to the second, open position (FIGS. 4–6), the clerk may place a bag in the well 30 against the base 39 and then package merchandise as it is passed across the scanner 36 on the checkout surface 22. When the clerk no longer has a need for the bag well 30, the cover member 32 may be returned to the first, closed position by grasping handle extension 33 (FIG. 4) and rotating the assembly about the pivots 50, 58 until the latch pin 82, described below, is again engaged.

As discussed above, it is desirable to provide a simple and facile mechanism for permitting rotation of the cover member 32 (together with the brackets 44, 52 and the base 39) from the first, closed position to the second, open position without the use of springs, pneumatic cylinders or electrical means. In doing so, however, it is also desirable to effectuate a rotation between the first and second positions in a manner which involves little risk of pinched fingers or similar injuries. To that end, there has been developed a simple and facile latch, release and tension mechanism which is referred to generally by reference numeral 60 in FIGS. 3, 4 and 7.

Figure 7:
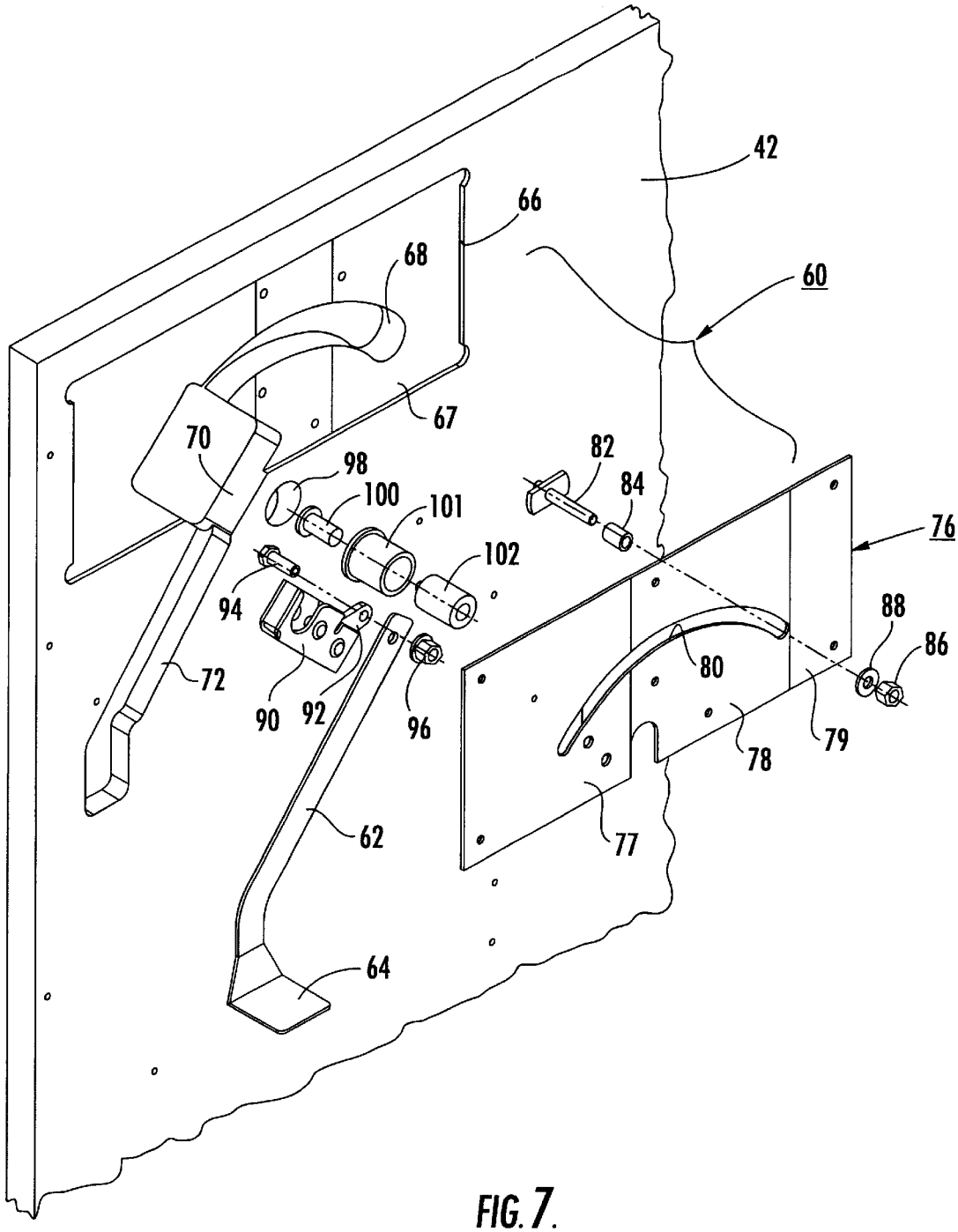
FIG. 7 is an exploded perspective view of the latch, latch release and tension portions of the bag well assembly shown in FIGS. 3–6.

As is shown in the exploded view of FIG. 7, the latch and tension plate assembly 60 is fitted within recesses in the side panel 42. These recesses include a relatively shallow routed recess 66 dimensioned to receive a tension plate 76, the recess having an internal surface 67 corresponding to the slope of the tension plate 76 as described in greater detail below. A routed curved raceway 68 extends completely though the side panel 42 within the recess 66 and acts a guide for a latch pin 82 and bearing 84, with the latch pin in turn extending through both the bracket 52 and a corresponding slot 80 in the tension plate 76. A generally rectangular routed recess 70 extends from the surface 67 through the side panel 42, and is dimensioned to receive a latch 90. A routed latch arm recess 72 also extends through the side panel 42 and downwardly from the latch recess 70; the latch arm recess 72 is dimensioned to receive the latch arm 62 in such a manner that the latch release lever 64 extends laterally away from the side panel 42 and underneath the scanner unit 36 (see FIG. 2).

Noting FIGS. 5 and 6, a friction plate 74 is fitted into a routed recess 75 along the inside surface of the side panel 42.

Referring again to FIGS. 6 and 7, the tension plate 76 is formed of three sections 77, 78 and 79; section 77 and 79 are somewhat parallel with each other, but do not lie in a common plane because of a relatively shallow slope or angular relationship of the intermediate panel 76, so that there is a greater dimension between the surface 67 and tension plate section 79, relative to the dimension between the surface 67 and tension plate section 77 when the tension plate 76 is mounted flush in the recess 66. As is shown in FIG. 7, the tension plate 76 includes the curved slot 80 which generally corresponds to the raceway 68 and is dimensioned to receive the latch pin 82 and bearing 84 which are held in place with fastener 86 and washer 88.

With reference to FIGS. 5, 6 and 7, it will be understood that the latch pin 82 extends through the bracket 52, the raceway 68 and the slot 80. The latch pin 82 remains in the first, closed position when engaged by the latch 90, until operation of the latch release lever 64 causes the latch release 92 at latch 90 to release the latch pin 82. The counter-balanced weight of the bag well assembly 30 causes the entire assembly to rotate around the pivots 44, 58 into the second, open position. As the latch pin 82 and bearing 84 move through the raceway 68 and the slot 80, the combination of the friction pad 74 and the sloped configuration of the tension plate 76 serve to reduce the rate of movement of the entire bag well assembly, until the assembly fully arrives at the second position.

With further reference to FIG. 7, the pivot 58 is effectuated with pivot pin 100 and outer and inner bushings 101, 102 which extend through opening 98 in side panel 42. A similar arrangement defines pivot 50.

While the present invention has been described in the context of a preferred embodiment, it will be appreciated by those skilled in the art that various modifications and changes can be made in the construction and methods described without departing from the spirit and scope of this invention.

What is claimed is:

1. A checkout counter construction, comprising:

an elongated counter having a bottom adapted to rest upon a support surface, first and second opposing sides extending generally upwardly from the bottom and a generally horizontal checkout surface extending between the opposing sides from an intake area to a discharge area, the counter defining a checkout clerk location along a portion of the first side;

a bag well adjacent the clerk location, the bag well extending into the counter from the checkout surface;

a bag well cover member rotatably fitted with the bag well and having an upper surface, the cover member movable between a first, closed position with the cover member upper surface generally parallel with the checkout surface and a second, open position which renders the bag well accessible to the clerk for placing merchandise into a bag positioned in the well Means for gradually increasing friction including a support panel extending laterally between the first and second opposing sides, the support panel having a curved raceway extending therethrough;

a sloped tension plate abutting an outside surface of the support panel, the tension plate having a slot corresponding to the raceway;

a latch pin pivotally fixed on one side of the first and second opposing sides and extending through the curved raceway and the slot of the sloped tension plate, the latch pin movable with the cover member between the first and second positions;

wherein the curved raceway corresponds to the path of movement of the latch pin during movement between the first and second positions; and wherein the rate of movement of the cover member is reduced as it approaches the second position so as to minimize risk of injury to the clerk.

2. The checkout counter construction recited in claim 1 wherein the means for reducing the rate of movement comprises:

a bracket fixed with and extending generally normal to an underside of the cover member, the bracket movable with the cover member between the first and second positions; and means for gradually increasing friction against movement of the bracket as the cover member approaches the second position.

3. The checkout counter construction recited in claim 1 further comprising:

a latch recess in the fixed support panel communicating with the curved raceway; and a latch fitted in the latch recess, the latch receiving and holding the latch pin until released.

4. The checkout counter construction recited in claim 3 further comprising:

a release arm recess in the fixed support panel; and a latch release arm fitted in the release arm recess and having a latch release lever at an end of the release arm for operating the latch to release the latch pin, to thereby permit movement of the bracket and the cover member from the first position toward the second position.

5. The checkout counter construction recited in claim 1 wherein the means for increasing friction further comprises:

means for pivotally mounting the cover member between the side panels such that the weight of the cover member causes movement of the cover member from the first position to the second position unless the cover member is restrained in the first position; and means for releasably latching the cover member in the first position.

6. The checkout counter construction recited in claim 5 wherein the means for pivotally mounting the cover member comprises:

a pair of brackets, each bracket extending from the cover member and generally parallel with an adjacent one of the side panels; and a pivot extending through each bracket and into the adjacent side panel at a point that the facilitates movement of the cover member from the first position to the second position unless the cover member is restrained in the first position.

7. The checkout counter construction recited in claim 6 further comprising a bag well base extending generally normal from an inside edge of the cover member and generally normal to the brackets, the base forming a bottom of the bag well when the cover member is rotated into the second position.

8. The checkout counter construction recited in claim 6 further comprising a bag well base extending generally normal from an inside edge of the cover member, the base forming a bottom of the bag well when the cover member is rotated into the second position.

9. A checkout counter comprising:

a generally horizontal surface;

a storage well extending into the surface;

a storage well cover member rotatably fitted with the bag storage well, the cover member movable between a first, closed position limiting access to the well and a second, open position which renders the well accessible for placing items into a container positioned in the well Means for gradually increasing friction including a support panel extending laterally between the first and second opposing sides, the support panel having a curved raceway extending therethrough;

a sloped tension plate abutting an outside surface of the support panel, the tension plate having a slot corresponding to the raceway;

a latch pin pivotally fixed on one side of the first and second opposing sides and extending through the curved raceway and the slot of the sloped tension plate, the latch pin movable with the cover member between the first and second positions;

wherein the curved raceway corresponds to the path of movement of the latch pin during movement between the first and second positions; and wherein the rate of movement of the cover member is reduced as it approaches the second position so as to minimize risk of injury to the clerk.

10. The counter recited in claim 9 wherein the means for increasing friction comprises a bracket fixed with and extending generally normal to an underside of the cover member, the bracket movable with the cover member between the first and second positions.

11. The counter recited in claim 10 further comprising:

a latch recess in the fixed support panel communicating with the curved raceway; and a latch fitted in the latch recess, the latch receiving and holding the latch pin until released.

12. The counter recited in claim 11 further comprising:

a release arm recess in the fixed support panel; and a latch release arm fitted in the release arm recess and having a latch release lever at an end of the release arm for operating the latch to release the latch pin, to thereby permit movement of the bracket and the cover member from the first position toward the second position.

13. The counter recited in claim 9 further comprising means free of springs, pneumatic cylinders and electrical means for permitting movement of the cover member from the first position to the second position.

14. The counter recited in claim 13 wherein the means for permitting movement of the cover member from the first position to the second position comprises:

means for pivotally mounting the cover member between the side panels such that the weight of the cover member causes movement of the cover member from the first position to the second position unless the cover member is restrained in the first position; and means for releasably latching the cover member in the first position.

15. The counter recited in claim 14 wherein the means for pivotally mounting the cover member comprises:

a pair of brackets, each bracket extending from the cover member and generally parallel; and a pivot extending through each bracket to facilitate movement of the cover member from the first position to the second position unless the cover member is restrained in the first position.

16. The counter recited in claim 9 further comprising a well base extending generally normal from an inside edge of the cover member, the base forming a bottom of the well when the cover member is rotated into the second position.

* * * * *